US008562216B2

(12) United States Patent
Kendall et al.

(10) Patent No.: US 8,562,216 B2
(45) Date of Patent: Oct. 22, 2013

(54) TEAR AWAY OPENING FOR MULTI-LAYER PLASTIC PACK

(75) Inventors: Brian Andrew Kendall, Maineville, OH (US); Murray Fullerton, Papakura (NZ)

(73) Assignee: PAC Worldwide Corporation, Redmond, WA (US)

( * ) Notice: Subject to any disclaimer, the term of this patent is extended or adjusted under 35 U.S.C. 154(b) by 1238 days.

(21) Appl. No.: 10/823,080

(22) Filed: Apr. 13, 2004

(65) Prior Publication Data

US 2005/0226542 A1 Oct. 13, 2005

(51) Int. Cl.
*B65D 33/00* (2006.01)
*B65D 65/26* (2006.01)

(52) U.S. Cl.
USPC ..... 383/207; 383/209; 383/200; 383/84; 229/81; 229/313

(58) Field of Classification Search
USPC ..... 383/207, 208, 209, 313, 316, 200, 383/203–206, 66, 84; 428/43; 229/81, 313, 229/87.05
See application file for complete search history.

(56) References Cited

U.S. PATENT DOCUMENTS

| | | | | |
|---|---|---|---|---|
| 1,227,215 | A | 5/1917 | Tanaka | |
| 2,315,116 | A | 3/1943 | Flizikowski | |
| 3,055,575 | A | 9/1962 | Gerard | |
| 3,127,087 | A * | 3/1964 | Spees | 383/205 |
| 3,239,128 | A * | 3/1966 | Rumberger | 229/203 |
| 3,265,287 | A * | 8/1966 | Hovland | 206/264 |
| 3,318,510 | A * | 5/1967 | Quarles, III et al. | 229/313 |
| 3,394,872 | A | 7/1968 | Robak | |
| 3,539,093 | A * | 11/1970 | Massengill | 229/101.1 |
| 3,592,380 | A | 7/1971 | Gerard | |
| 3,650,463 | A * | 3/1972 | Christiansen et al. | 229/81 |
| 3,909,582 | A * | 9/1975 | Bowen | 219/121.69 |
| 3,951,333 | A * | 4/1976 | Forbes et al. | 229/207 |
| 4,351,433 | A * | 9/1982 | Barber et al. | 206/264 |
| 4,580,683 | A | 4/1986 | Gochenour | |
| 4,607,749 | A * | 8/1986 | Jacob | 229/313 |
| 4,621,736 | A * | 11/1986 | Roccaforte | 229/101.1 |
| 4,773,541 | A * | 9/1988 | Riddell | 229/235 |
| 4,778,058 | A * | 10/1988 | Yamazaki et al. | 383/200 |
| 4,781,296 | A | 11/1988 | Morris et al. | |
| 4,834,552 | A * | 5/1989 | Makowka | 383/5 |
| 5,135,790 | A * | 8/1992 | Kaplan et al. | 428/77 |
| 5,203,634 | A * | 4/1993 | Kim | 383/205 |
| 5,683,029 | A | 11/1997 | Lyons | |
| 5,738,274 | A * | 4/1998 | Stude | 229/301 |
| 5,826,985 | A * | 10/1998 | Goodman et al. | 383/200 |
| 5,902,047 | A * | 5/1999 | Yeager | 383/203 |
| 6,006,907 | A * | 12/1999 | Sato et al. | 206/387.1 |
| 6,354,739 | B1 | 3/2002 | Sheehan, Jr. et al. | |

(Continued)

FOREIGN PATENT DOCUMENTS

FR 2 680 159 A1 2/1993

*Primary Examiner* — Jes F Pascua
*Assistant Examiner* — Peter Helvey
(74) *Attorney, Agent, or Firm* — Christensen O'Connor Johnson Kindness PLLC

(57) ABSTRACT

A tearable closure and a container with a tearable closure is disclosed. The tearable closure includes non-penetrating perforations or score lines in and across the tearable closure on a first side, and has continuous film material on the second side. Such tearable closure can be incorporated into one of numerous types of containers, including envelopes, boxes, and bags. The tearable closure can be a flap, a lid, or a tape.

32 Claims, 7 Drawing Sheets

(56) References Cited

U.S. PATENT DOCUMENTS

| | | | | |
|---|---|---|---|---|
| 6,427,420 | B1 * | 8/2002 | Olivieri et al. | 53/412 |
| 6,440,514 | B1 * | 8/2002 | Ueno et al. | 428/43 |
| 6,595,353 | B1 * | 7/2003 | Focke et al. | 206/245 |
| 6,679,629 | B1 * | 1/2004 | Benito-Navazo | 383/9 |
| 6,726,363 | B1 * | 4/2004 | Marbler et al. | 383/200 |
| 6,964,520 | B1 * | 11/2005 | Sakai et al. | 383/207 |
| 7,111,986 | B2 * | 9/2006 | Marbler et al. | 383/200 |
| 2007/0297702 | A1 * | 12/2007 | Zaggia et al. | 383/200 |

* cited by examiner

TEAR AWAY OPENING FOR MULTI-LAYER PLASTIC PACK

FIELD OF THE INVENTION

The present invention is related to opening mechanisms for opening sealed containers, including multi-layer plastic packs, such as envelopes used by overnight or express mail delivery services.

BACKGROUND OF THE INVENTION

Packages that are sent from a sender to a receiver will require opening by the receiver. Many packages come with a flap that can be folded over to seal the package opening. Packages with flaps or other closures require a way of sealing the package and a way of opening the sealed package. Both sender and receiver have concerns regarding the integrity of the package during transit. Both sender and receiver are motivated to have a robust seal that will resist tearing or opening. Robust seals are typically achieved with an adhesive on the flap that bonds to the container. Lifting the flap that has been bonded to the container with an adhesive is, however, a difficult task. Accordingly, there have been many proposals for facilitating the opening of sealed packages that rely on the tearing of the flap that seals the package. Such proposals mainly rely on the use of perforations, strings, and tear strips.

The considerations for deciding which mechanism to utilize for opening packages are related to the construction materials of the package, the materials' tear properties, the complexity of manufacturing, and the associated costs.

Some users may prefer packages with robust opening mechanisms above all else, while other users may prefer the easier opening mechanisms that are nevertheless reliable enough to withstand typical handling while in transit.

While the advantages of robust opening mechanisms are evident, many of these packages involve complex or intricate manufacturing processes leading to higher prices which the consumer is less willing to accept. Examples may include strings and tear strips that are made from materials different to the flap or closure material. Strings and tear strips function by either being embedded within the flap material or by being directly adjacent to the flap, so that pulling on the string or tear strip will cause cutting or tearing of or through the flap material. Because strings and tear strips are external devices that must be integrated into the flap, manufacturing complexity is introduced.

A simpler, but more prone to inadvertent opening, is an opening mechanism that is made from the flap material itself. Perforations that completely penetrate the flap material are made along two rows to weaken the flap material along a specified narrow strip of material. It is generally regarded that such opening mechanism will sacrifice package integrity. This is because the flap is, in essence, connected to the remainder of the envelope with perhaps only as much as half of the flap material between the perforations. Furthermore, because the perforations will be visible and exposed in the exterior side of the flap, the perforations are likely starting points where, if enough pressure is applied by an object, a tear might ensue.

Accordingly, there is a need to provide an opening mechanism that given a robust seal will nevertheless be easy to open, but will be less likely to open inadvertently.

SUMMARY OF THE INVENTION

The present invention is related to tearable closures, the containers with the tearable closures, and to methods of making tearable closures and containers. The tearable closure comprises rows of non-penetrating perforations or score lines in and across the tearable closure on a first side. The tearable closure comprises continuous film material on the second side.

One embodiment of the present invention is related to a container. The container includes a container body defining a cavity. The container body has a first and a second wall defining the front and back of the container. A flap is connected to the container body. The flap can be folded, and bonded to the container to seal the cavity. The flap includes non-penetrating perforations in the flap that are approximately from one end of the length of the flap to the opposite end of the length of the flap (length's end to length's end). The non-penetrating perforations do not cut entirely through the thickness of the flap, but are only partially cut into the flap to leave more material connecting the flap to the container than prior flaps.

Another embodiment of the present invention is related to a method for making a container with a flap. The method includes bonding a first film to a second film to produce a composite sheet. The method of making the container with the flap also includes folding the composite sheet and then bonding the two overlapped edges to form a cavity from the sheet and leaving a section of non-overlapping sheet that extends beyond the cavity that forms the flap. Non-penetrating perforations are added in the flap approximately from length's end to length's end of the flap or across the flap, and the non-penetrating perforations extend only partially into the thickness of the flap along two or more rows across the flap. A simple way to make non-penetrating perforations in the flap is to provide one film with perforations that extend through the entire thickness of the film before this film is bonded to a second film, and then bonding the perforated film to a second film which will result in non-penetrating perforations that extend only partially into the thickness of the composite sheet made from the two films. This has the advantage that precise control of the perforation depth does not have to be attempted after the bonding of the two films. The container is made so that the non-perforated film will be the exterior of the container.

Another embodiment of the present invention is related to making a container with a tearable closure. A tearable closure is any means for closing the opening of the container and there is a means in the closure for tearing the closure to open the container. The method includes forming the container and the tearable closure, wherein the tearable closure includes non-penetrating perforations that extend partially into the thickness of the tearable closure and across the tearable closure.

Another embodiment of the present invention is related to a container with a tearable closure. The tearable closure includes non-penetrating perforations that extend partially into the thickness of the tearable closure and across the tearable closure. Representative containers are envelopes, boxes and bags. Representative tearable closures are flaps, lids and tapes.

Another embodiment of the present invention is related to a tearable closure that can be incorporated into containers to facilitate opening the sealed containers. The tearable closure includes non-penetrating perforations that extend partially into the thickness of the tearable closure and across the tearable closure. Representative tearable closures are flaps, lids and tapes.

The tearable closure and container with tearable closure in accordance with the present invention have numerous advantages over the prior art means for opening sealed containers.

First, the tearable closure of the invention does not need an external material to assist in tearing the tearable closure that is made from a material different to the closure material. Second, the tearable closure material is provided with non-penetrating perforations that extend partially into the thickness of the closure material and across the closure so that the perforations are not exposed and more of the flap material is remaining as compared to perforations that cut through the entire thickness of the flap. The use of a weakened closure rather than an external device eliminates manufacturing complexity and costs, and the fact that perforations do not cut through the entire thickness of the closure material decreases the likelihood that the closure will tear inadvertently.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention is related to methods of opening containers and to containers with opening mechanisms, and to the opening mechanisms. The present invention provides a tearable closure, wherein the closure can be a flap, a lid, or a tape. The tearable closure has a first side and a second side. On one side, the tearable closure has areas of reduced thickness arranged along rows or lines across the tearable closure. At least two rows or lines are present in the tearable closure so that the tearable closure will be able to tear along two of the rows or lines and thus release the tearable closure from a container to which it is attached, and thus open the container. The areas of reduced thickness in the tearable closure can be score lines that are continuous reduced areas of thickness in a line across the closure or any other part of the container, or the areas of reduced thickness in the tearable closure can be non-penetrating perforations in a row across the closure or any other part of the container. The score lines or non-penetrating perforations do not cut completely through the thickness of the closure, but are only partly cut into the closure material. By avoiding the cutting of closure material completely, the closure is strengthened, but will still be able to tear. On the side opposite to the side in which the score lines or non-penetrating perforations are provided, the tearable closure is continuous, meaning the tearable closure material is made from a continuous film material that has no areas that are of composition different to all other areas of the tearable closure. For example, if the tearable closure is made from a film material, the film material would not have areas made of fibers. The tearable closure can be connected to various containers, including envelopes, boxes, and bags to provide a means for opening the container.

Figure 1:
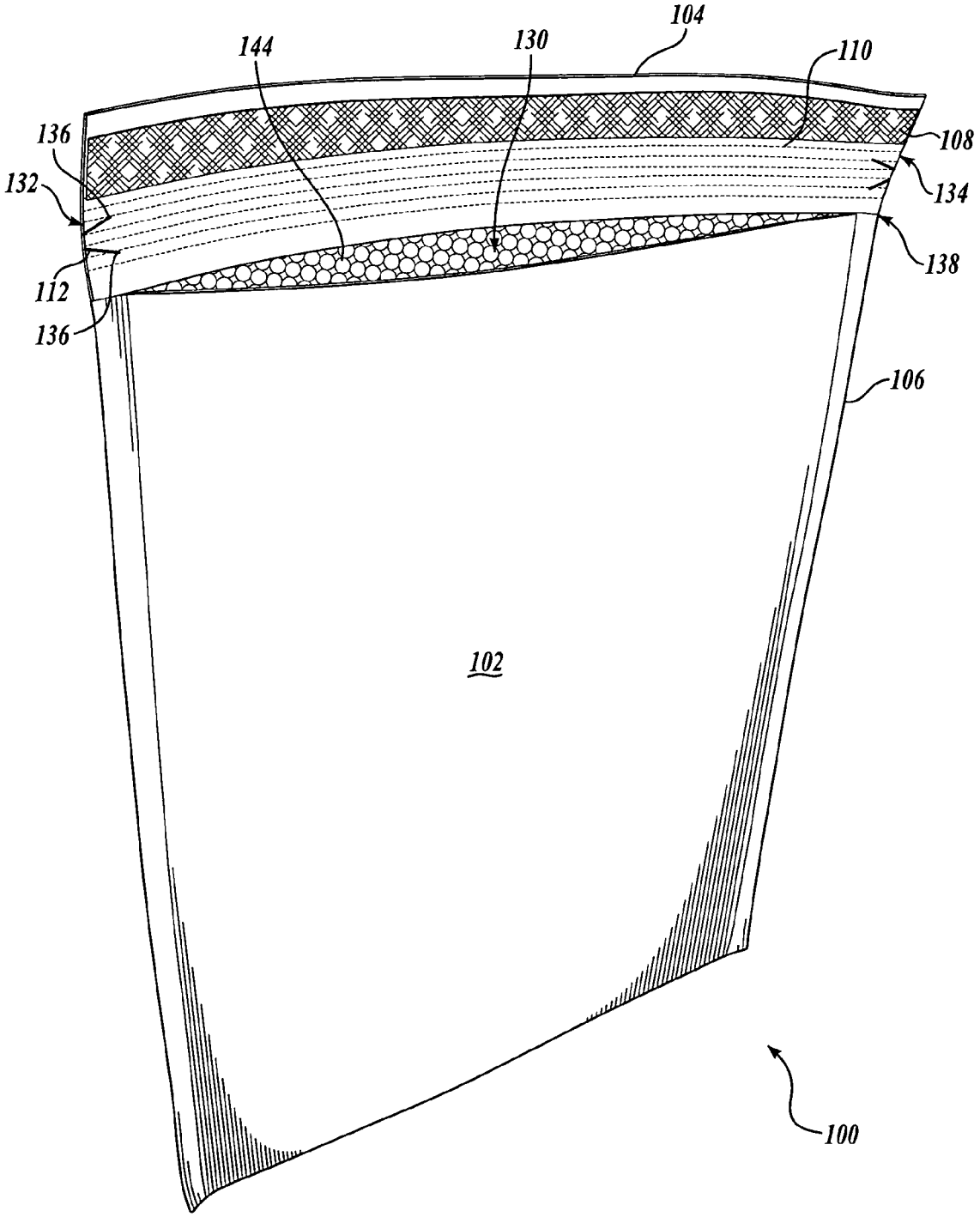
FIG. 1 is an illustration of a container according to the present invention.

Referring to FIG. 1, a container 100 according to the present invention is illustrated. The container 100 includes a container body 102 defining a cavity 130 between the first and second (front, back) sides of the container body 102. It is to be appreciated that the first and second sides may be a length of material that has been folded and bonded at the edges. The container 100 includes a flexible flap 104 that is connected to the container body 102 at location 138 to allow the flap 104 to fold over the cavity opening and seal the cavity 130. In one embodiment of the present invention, the interior of the cavity 130 can be provided with padding material, such as a "bubble sheet" 144 as further discussed below. The flap 104 is integrally connected to the container body 102, i.e., the flap 104 is made from the same length of material used to form the container 100 front and back sides. The flap 104 includes non-penetrating perforations 110 in one side of the flap 104. The opposite side of the flap 104 is made from a continuous film material. The non-penetrating perforations 110 are generally aligned along rows approximately from the end of the flap's length 132 to the flap's opposite length end 134 and the rows are parallel to each other across the flap 104. The non-penetrating perforations 110 can begin at the flap's 104 edge, or a short distance away from the edge.

Figure 2:
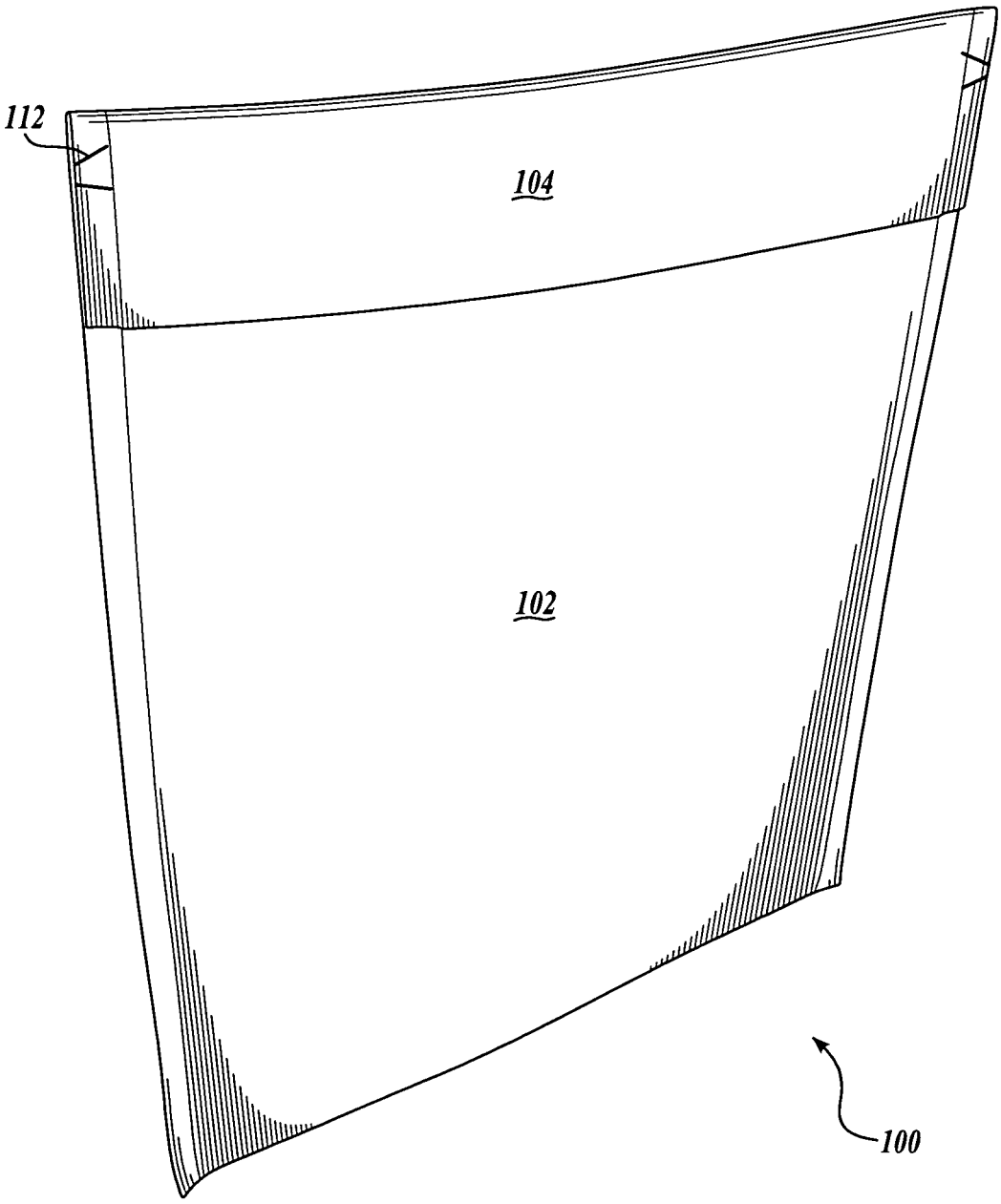
FIG. 2 is an illustration of a container according to the present invention.

The flap 104 has a second side, wherein the first side is the side with non-penetrating perforations shown in FIG. 1, and the second side is the side of flap 104 without perforations shown in FIG. 2. The second side of the flap that does not have the non-penetrating perforations is made from a continuous film material. In a preferred embodiment, the non-penetrating perforations 110 are in the first side of the flap 104 that result in the non-penetrating perforations being concealed when the flap 104 is folded to seal the container. This reduces the possibility that a tear may develop if the perforations are exposed to the exterior. However, alternate embodiments of the container 100 may have the non-penetrating perforations 110 in the second side, i.e., on the exterior of the flap 104, but not on the first or interior side. Non-penetrating when referring to perforations 110, means that perforations 110 do not extend completely through the thickness of the flap 104 but merely extend partially into the thickness of the flap 104. Not included in the meaning of non-penetrating perforations are the starting nicks 112 that can fully cut through the entire thickness of the flap 104 as seen to occur in FIGS. 1 and 2.

Nicks 112 are located in either one or both of the first and second flap sides at either one or both flap edges 132, 134. The flap material between nicks 112 produce a tab that can be pulled to initiate tearing of the flap 104 in a narrow strip of flap material that is defined between any two rows of non-penetrating perforations 110. Once the narrow strip of flap material is removed, part of the flap remains adhered to the container, and part of the flap is freed to open the container. Nicks 112 can be at an angle to the rows of non-penetrating perforations 110. According to the present invention, at least two rows of non-penetrating perforations 110 are provided in the flap so as to coincide with the end points 136 of the starting nicks 112. More than two rows of non-penetrating perforations are advantageous in the flap 104. Multiple rows have the advantage that starting nicks 112 do not have to align exactly with the rows of non-penetrating perforations 110, but allows for a small margin in error, as long as the end points 136 of the nicks 112 lie within the boundaries of rows of non-penetrating perforations 110, the angle in a starting nick 112 will cause the flap material to tear in a direction headed for one row. Once the tear reaches a row of non-penetrating perforations, the tear will follow the path of weakness which is along the row of non-penetrating perforations 110. Rows are aligned substantially parallel to each other approximately from length's end 132 to length's end 134 of the flap 104, i.e., across the flap. The non-penetrating perforations 110 are aligned along the row intermittently, therefore, in the direction of any row, the flap 104 has areas of the full flap thickness followed by areas of reduced thickness that is decreased by the depth of the non-penetrating perforation. The non-penetrating perforations 110 therefore allow tearing of that portion of the flap 104 that is bounded by two rows. The section of flap 104 that is bounded by any two or more rows is flap material and not a distinct tear strip of different material to the flap. Thus, when the flap 104 has been sealed to the container 100; pulling the area of the flap 104 between any two rows of non-penetrating perforations 110, will allow a narrow flap portion to be torn across the flap that will expose the interior of cavity 130 of the container body 102.

Figure 3:
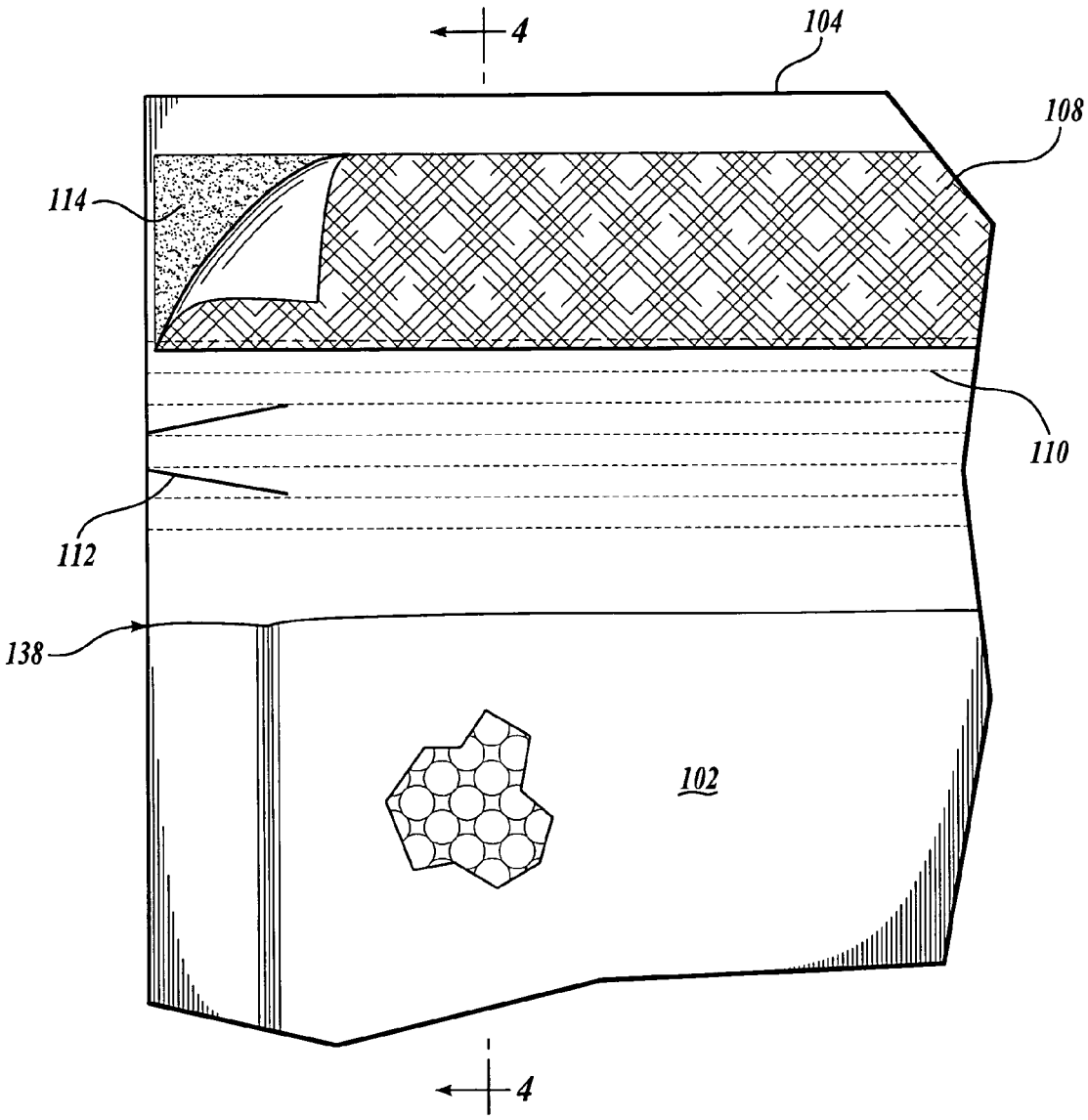
FIG. 3 is an illustration of a container portion according to the present invention.

Referring to FIG. 3, flap 104 is connected to the container body 102 at hinge location 138. A strip of an adhesive 114 can be applied on the flap 104 from the flap's length end 132 to the opposite end 134 of the flap's length. Suitable adhesives for use in sealing containers with flaps are known in the art. A cover strip 108 can be applied on the side of the adhesive 108 that is not bonded to the flap 104. The cover strip 108 prevents the inadvertent adhesion to unwanted materials prior to sealing the container 100. Alternate sealing mechanisms besides adhesives can be used in the present invention. Furthermore, adhesive strip 114 and/or cover strip 108 can be applied to the container body 102, the flap 104, or both container body 102 and flap 104.

In one embodiment of the invention, the container 100 is a rectangular container where length and width have been adjusted to accommodate common paper sizes. Such container is generally referred to as an "envelope." Envelopes may come in flat or bulky configurations. The present invention however, can be utilized in opening any number of sealed containers that do not fall into the category of envelopes, such as boxes or bags of any dimension.

In one embodiment of the present invention, the container 100 can be made from a composite sheet having a length that is sufficient to be folded over to overlap with itself to form a cavity between the folded sections of sheet, at the same time also leaving an area of sheet that is not overlapping with itself, and that extends beyond the cavity. The non-overlapping section can be used as the flap. The two edges along the length of the sheet where the sheet has been overlapped on itself are bonded to one another to produce the cavity therebetween. The need to bond the sheet at the "bottom" of the container is eliminated because folding the sheet at this location produces a closed bottom without the need for bonding. However, it is to be appreciated that the container can be made by bonding two distinct panels of sheet, wherein one sheet is slightly longer than the other sheet so as to form a flap. In this instance, the two sheets would require bonding at the "bottom" of the container. Suitable materials from which the container 100 is made include synthetic and natural materials. Low density polyethylene, linear low density polyethylene, high density polyethylene, cast polypropylene, Kraton/polypropylene blends, wood pulp are materials for making the container 100.

Figure 4:
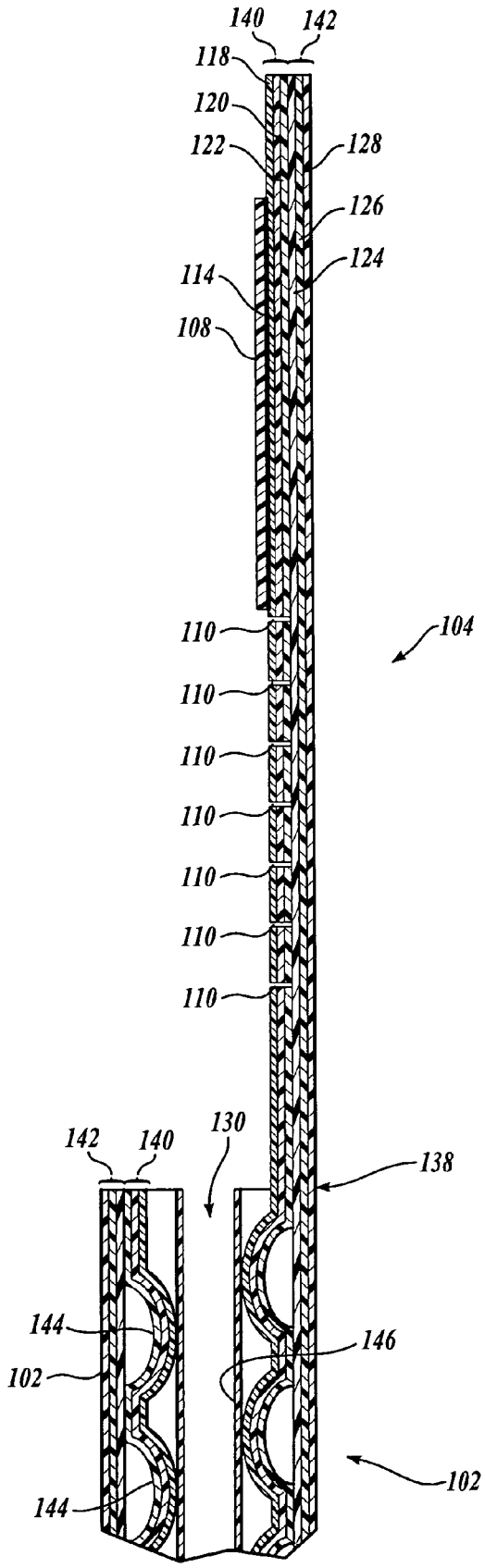
FIG. 4 is an illustration of a container portion according to the present invention.

Referring to FIG. 4, a cross-sectional illustration is provided of the container 100 in the area of the cavity opening 130 and flap 104 showing the details of a composite sheet out of which both the container body 102 and flap 104 are constructed.

In one embodiment of the container 100, the composite sheet is made from two films 140, 142, wherein each film 140 and 142 is in turn made from three layers of co-extruded polyethylene film material. It is to be appreciated that any number of films can be used to make the composite sheet as well as using any number of layers to make each film. With co-extruded polyethylene film, it may be difficult, if not impossible, to discern the boundaries between layers after co-extruding the polyethylene into a film. As can be seen in FIG. 4, the exterior side of the film 142 is continuous. The composite sheet results from the two films 140, 142 being bonded together at one of each respective films' major side so that the first film 140 and the second film 142 are adjacent to each other in the composite sheet.

In one embodiment of the container 100, one film can be opaque and one film can be translucent. The opaque film will usually be utilized for the exterior of the container 100. The opaque film is shown in FIG. 4 as film 142 made from the co-extruded polyethylene layers 124, 126, and 128 which may or may not retain their discrete character. Pigments can be added to one or more of the polyethylene layers 124, 126, and 128 to impart opacity to the film 142. White, gray or silver pigments can be added to one or more of the layers of film 142. Pigmentation is a matter of choice, however, white pigments are suited to be used in the two exteriormost layers 126, 128 of the film 142, while silver or gray pigments are suited to be used in the interiormost layer 124 of the film 142. In one embodiment of the container 100, the film 140 will be translucent. Because the film 140 is translucent, the gray or silver pigmentation of layer 124 will show through the film 140. The translucent film 140 is shown in FIG. 4 made from the three co-extruded polyethylene layers 118, 120 and 122 which may or may not retain their discrete character.

Still referring to FIG. 4, non-penetrating perforations 110 can be more clearly seen as completely penetrating the translucent film 140, but partially penetrating into the thickness of the composite sheet from which flap 104 is made. When flap 104 is made from two films, one of the films can be provided with perforations that completely cut through the entire thickness of the film, while the other film is not perforated, which will result in the non-penetrating perforations 110 seen in FIG. 4. This method simplifies the otherwise difficult task of applying non-penetrating perforations 110 to a flap material 104 that can be quite thin. Alternatively, the flap 104 can have continuous score lines across the flap 104 in place of the non-penetrating perforations. As with the non-penetrating perforations, the score lines would only be cut partially into the flap.

Referring to FIG. 4 again, adhesive strip 114 and cover strip 108 are seen on the flap 104 distally located from the hinge location 138 and more distal than the rows of non-penetrating perforations 110. Adhesive strip 114 and cover strip 108 can be provided on the flap 104 on the container body 102 or on both container body 102 and flap 104.

With reference to FIG. 4 yet again to enable description of one embodiment of a method of making the container 100 according to the present invention, the two three-layer co-extruded opaque and translucent polyethylene films 140, 142 are heat bonded to one another to form the composite sheet that is used to form the container body 102 and flap 104 of the container 100. According to one embodiment of the present invention, the translucent three-layer co-extruded polyethylene film 140 is passed over a heated hollow roller that has holes defining the diameter of the bubbles 144. The hollow roller is provided with a source of vacuum in the interior of the roller. The heat of the roller coupled with the vacuum on the interior of the roller will cause the polyethylene film 140 to deform in accordance with the diameter of the holes and thus form dimples on the film 140. The opaque three-layer co-extruded polyethylene film 142 is also heated by passing through a heated roller. While both films 140 and 142 are heated, the opaque and translucent three-layer co-extruded polyethylene films 140, 142 are pressed together so that the opaque film 142 is bonded to the translucent film 140 so that film 142 is applied to the area of film 140 in-between the concave side of the dimples 144. Bonding takes place while the translucent film 140 is on the hollow roller or shortly thereafter. Polyethylene films when heated and pressed together through two nip rollers to apply pressure will melt and fuse creating a permanent bond between films. A third polyethylene film 146 can be likewise heated and bonded to translucent film 140 after film 140 has been removed from the hollow roller so that film 146 is on the convex side of the dimples 144 as seen in FIG. 4. The third film 146 can also be a three-layer co-extruded polyethylene film, or the third film 146 can be a mono-extruded polyethylene film as shown in FIG. 4. The third film 146 can be either opaque or translucent. This third polyethylene film 146 is also passed over a roller that is heated and pressed under pressure to the translucent film 140.

In one embodiment of the invention, perforations 110 or score lines may be added to the translucent polyethylene film 140 prior to the formation of the dimples and prior to bonding with the opaque film 142. While perforations 110 will extend completely through the thickness of the translucent film 140, it should be noted that once the translucent film 140 and the opaque film 142 are bonded to each other into a composite sheet, the composite sheet will have non-penetrating perforations 110 that partially extend into the thickness of the composite sheet thickness because the opaque film 142 has not been perforated. According to the invention, the creation of a flap 104 that is perforated partially into its thickness, will nevertheless, allow the flap 104 to tear along a defined narrow flap section and will be stronger and more resistant to tearing inadvertently than if perforations are cut through the entire flap thickness. According to the invention, any closure for a container can be provided with non-penetrating perforations that extend across the closure and partially into the thickness of the closure to enable the tearing of the closure and the opening of the sealed container.

Figure 5:
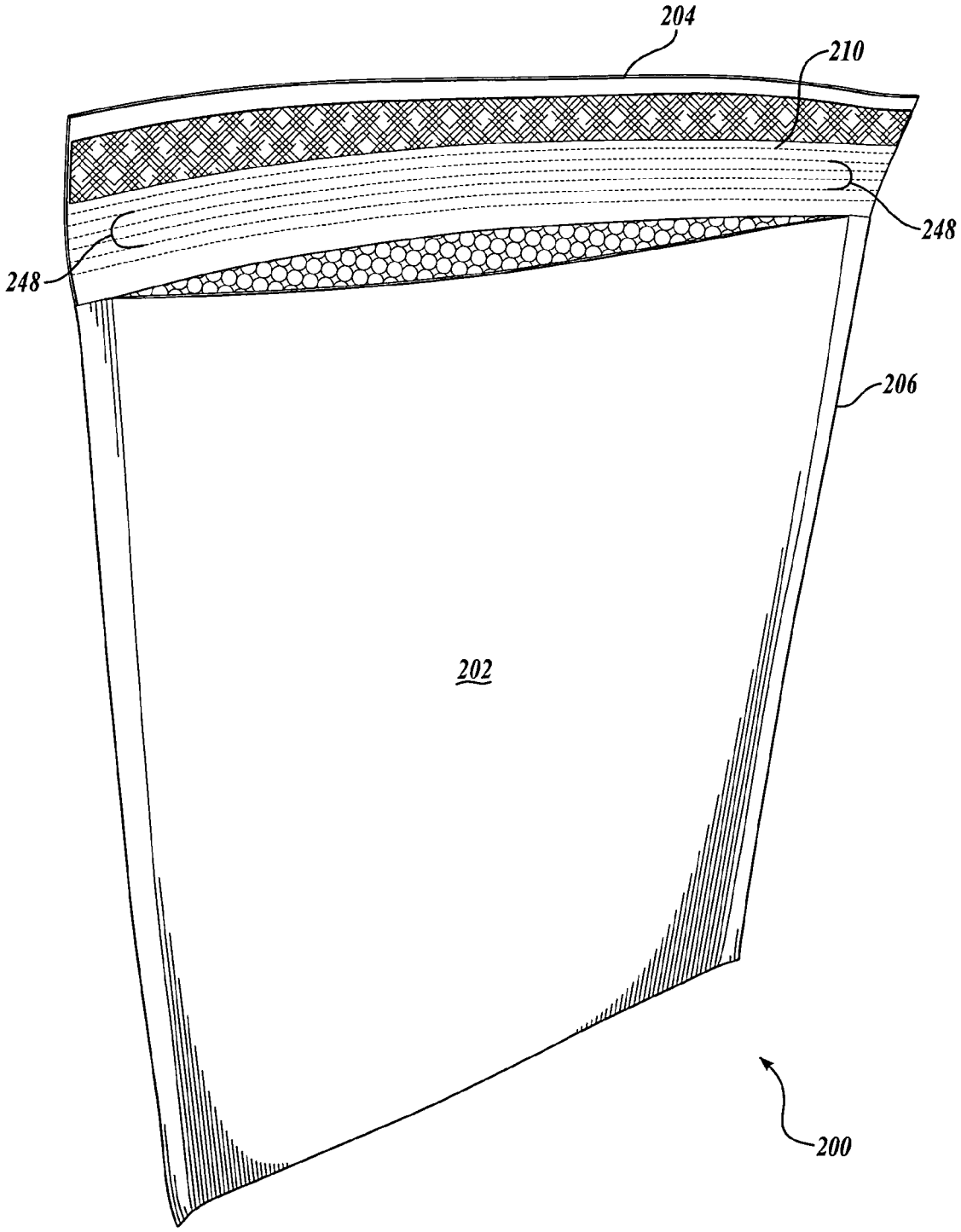
FIG. 5 is an illustration of a container according to the present invention.

Referring to FIG. 5, an alternate embodiment of a container 200 is illustrated having tabs 248 in place of nicks 112 shown in FIG. 1. Tabs 248 are punch cut within the boundaries of the uppermost and the lowermost row of non-penetrating perforations 210. In this embodiment, tabs 248 are set a small distance away from the edge of the flap 204. Tabs 248 are punch cut clear through the flap material, so that punch cut tabs 248 penetrate from one side of the flap 204 through the opposite side. As with nicks 112, punch cut tabs 248 do not have to align exactly with the rows of non-penetrating perforations 210. Tabs 248 provide a place to grasp a section of the flap material that is in-between the uppermost and the lowermost row of non-penetrating perforations 210. Pulling an area of the flap 204 between any two rows of non-penetrating perforations 210, will allow a narrow flap portion to be torn across the flap 204 that will release a portion of the flap from the portion of the flap that is adhered to the container thereby exposing the interior of the container body 202.

Figure 6:
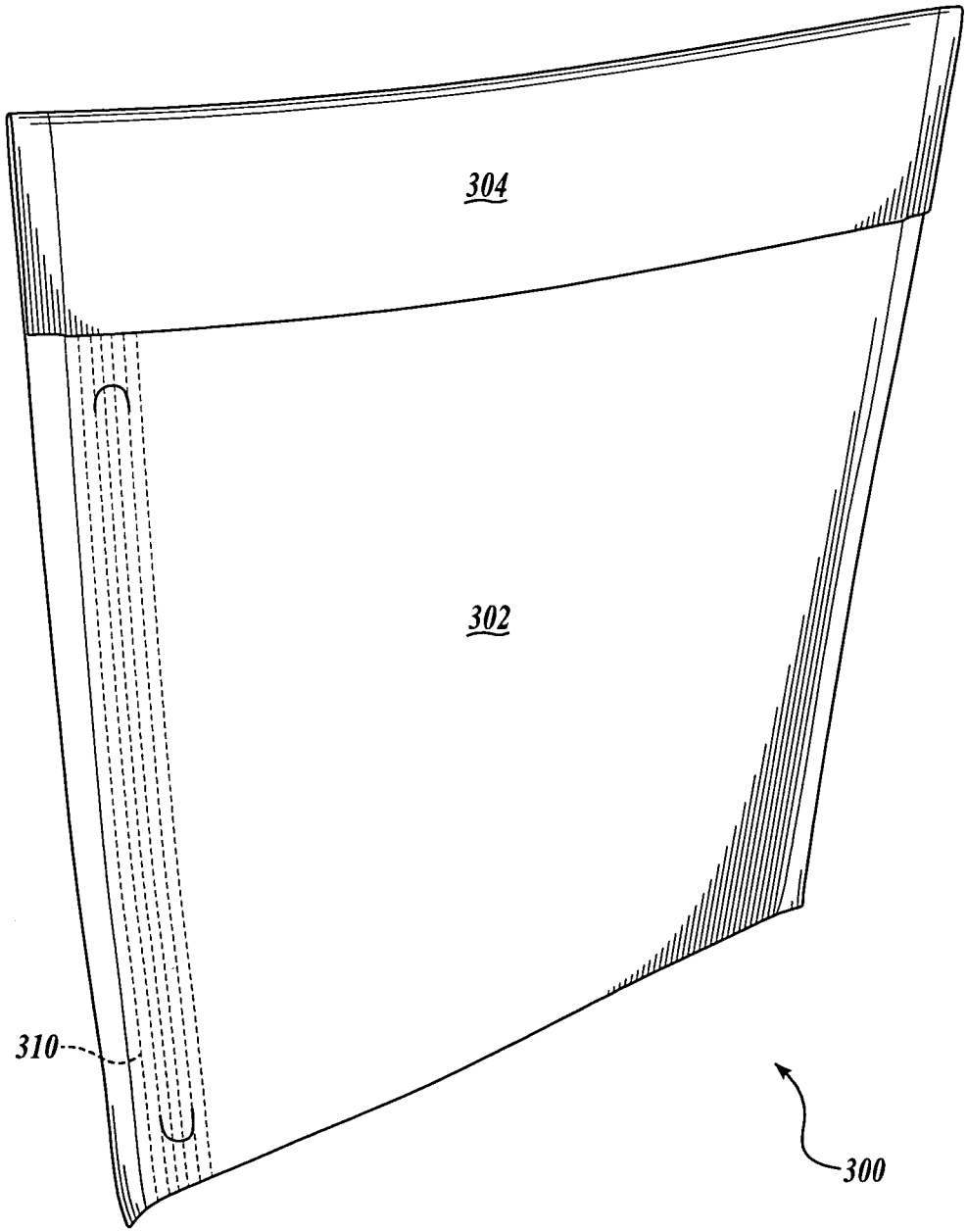
FIG. 6 is an illustration of a container according to the present invention.

Referring now to FIG. 6, an alternate embodiment of a container 300 according to the invention is shown. Container 300 includes a container body 302 and a flap 304 connected to the container body 302. Flap 304 or container body 302 may include a narrow strip of adhesive (not shown) to bond the flap 304 to the container body 302. In the embodiment of the container 300 shown in FIG. 6, the non-penetrating perforations 310 are located near the edge of the container body 302 and are in the interior so as not to expose the non-penetrating perforations to the exterior. In fact, rows of non-penetrating perforations 310 can be placed in any location of any container whether it be an envelope, a box, or a bag. For example, besides being interior and near one edge of the container 300, rows of non-penetrating perforations 310 can be placed interiorly or exteriorly on one or more edges of the container 300, and may even include non-penetrating perforations that circumscribe the entire container 300 periphery. Thus, non-penetrating perforations can be provided in any one or more sides of the container 300, so as to open one side, two sides, three sides, or even all four sides so as to substantially remove an entire front or back panel of the container 300.

Figure 7:
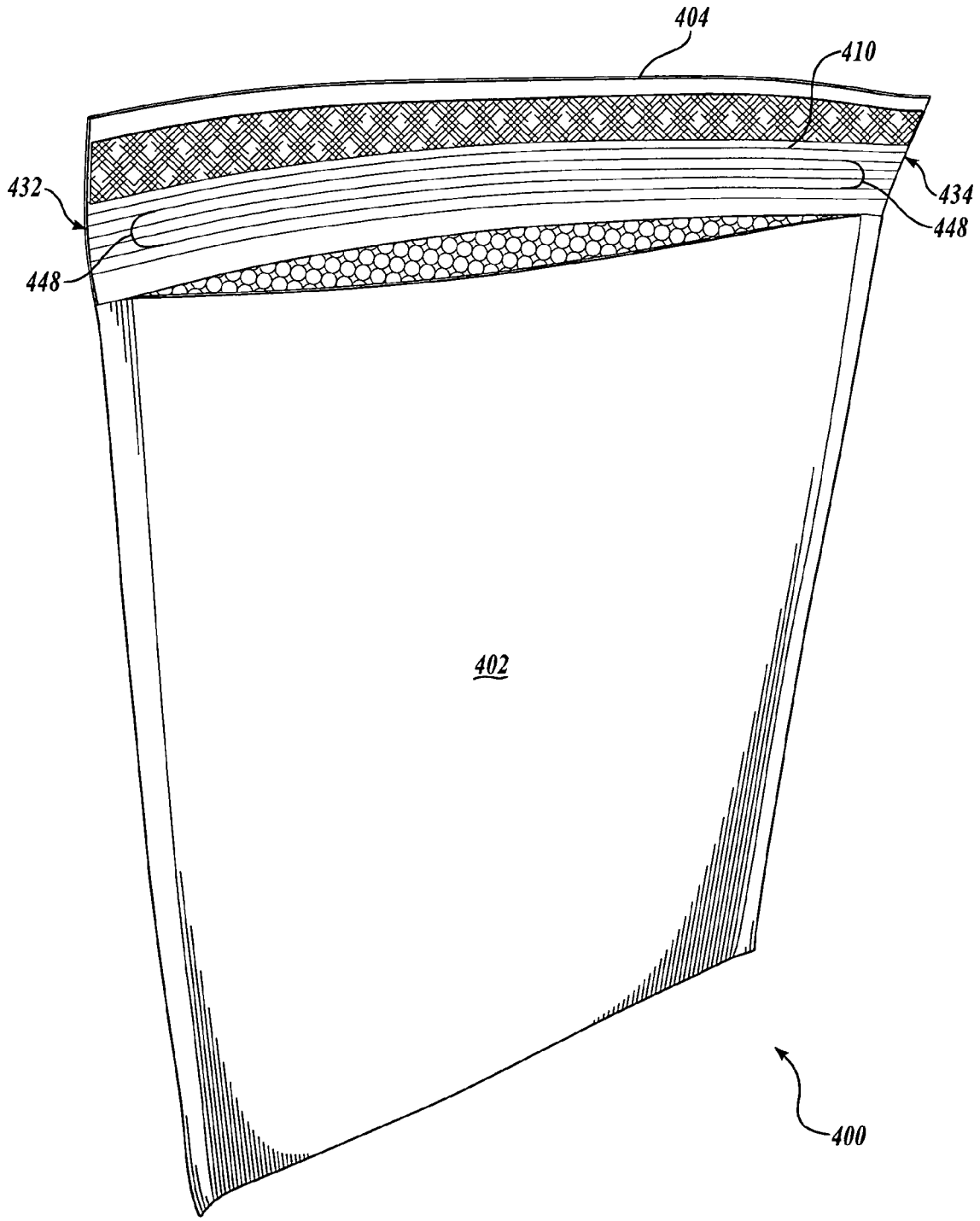
FIG. 7 is an illustration of a container according to the present invention.

Referring now to FIG. 7, an alternate embodiment of a container 400 with tearable closure 404, is illustrated. In the embodiment shown in FIG. 7, the container 400 includes a container body 402 and a tearable closure 404 which is connected to the container body 402. Flap 404 or container body 402 may include a narrow strip of adhesive (not shown) to bond the flap 404 to the container body. The embodiment of the container of FIG. 7 includes score lines 410 rather than non-penetrating perforations across the flap 404 from end 432 to end 434. Score lines 410 do not fully penetrate the thickness of the flap 404, but are reduced areas of thickness in one side of the flap. The side of the flap that cannot be seen in FIG. 7 is a continuous film material, meaning that film material forms the surface. At least two score lines 410 crossing the flap are provided, however, a plurality of score lines 410 may be provided in the flap 404 to allow a slight error in the alignment with the punch cut tabs 448. Score lines 410 are continuous lines of reduced thickness of flap material across the flap 404. Score lines 410 and non-penetrating perforations, enable tearing a narrow strip of flap material across the flap 404 that separates a portion of the flap from the portion of the flap that is bonded to the container to thus open the container. Score lines 410 may be cut into the flap 404 so as not to fully penetrate the flap 404. Alternatively, score lines 410 may be made by lasers that reduce the thickness of the flap 404 along a continuous line.

An alternate embodiment of the present invention is tape that has non-penetrating perforations to both close and open a container wherein the container does not need to include an adhesive for bonding the flap to the container body, and also does not include any non-penetrating perforations on the flap because the tape can be used to both close and open the container. A tape, according to the present invention, can be constructed that has a first and a second film, wherein one film has been provided with penetrations that completely extend through the thickness of the one film but not the second film. The film with perforations can be narrower than the film without the perforations. An adhesive layer can be added to one or the other film, wherein the adhesive can be used to close a container. Thus, the tape can be used as a means of closing the container and as a means for opening the container, wherein the means for closing the container includes the adhesive that has been applied to the film; and the means for opening the container is the two or more rows of non-penetrating perforations on one of the films. Once the tape with non-penetrating perforations has been applied to close the container, the tape provides for a way of opening the container by tearing a strip of tape that is bounded by any two rows of non-penetrating perforations.

The tape is not integral to any container, but is a separate product, and may be used to close and open containers. For example, a bag opening can be closed with a tape with non-penetrating perforations which can then be used to open the bag.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A tearable closure for opening a sealed container, comprising:

at least first and second films bonded together, wherein the first and second films are polymer films, the first film facing the interior of the sealed container and including a plurality of rows of perforations or score lines that extend through the thickness of the first film across the tearable closure, and the second film facing the exterior of the sealed container and being a continuous film material, wherein a first row or line and a second row or line define outermost rows or lines on the closure, and a plurality of rows or lines in addition to the first and second rows or lines are positioned between the first row or line and the second row or line, and wherein each row or line extends approximately from end to end along a length of the closure, and the tearable closure includes a tear initiating portion, the tear initiating portion including two cuts through the first and second films, wherein each cut ends within an area bounded by the outermost rows or lines, and the ends of the cuts are separated by at least two rows or lines.

2. The tearable closure of claim 1, wherein the tearable closure is a flap, lid or tape.

3. The tearable closure of claim 1, wherein the second film does not include perforations or score lines.

4. A container with a tearable closure, comprising:

a container body defining a cavity; and a tearable closure connected to the container body comprising a polymer film, the tearable closure being positionable in open or closed orientations, the tearable closure having first and second sides and a thickness extending therethrough. wherein the first side has a plurality of score lines that extend through a portion of the thickness of the film and the second side does not include score lines, wherein the first side is an inner side when the closure is positioned in the closed orientation, wherein a first score line and a second score line define outermost score lines on the closure, and a plurality of score lines in addition to the first and second score lines are positioned between the first score line and the second score line, and wherein each score line extends approximately from end to end along a length of the closure, and the tearable closure includes a tear initiating portion, the tear initiating portion including a pair of cuts through the closure, wherein each cut ends within an area bounded by the outermost score lines, and the ends of the cuts are separtated by at least two score lines.

5. The container of claim 4, wherein the container is an envelope.

6. The container of claim 4, wherein the tearable closure is a flap, lid, or tape.

7. The container of claim 4, wherein the container is an envelope and the tearable closure is a flap.

8. The container of claim 4, wherein the tearable closure comprises a first and a second film, wherein the first film has perforations that extend completely through the thickness of the first film, and the second film does not include perforations.

9. A container, comprising:

a container body defining a cavity; and a tearable flap connected to the container body, wherein the flap comprises an inner translucent film and an outer opaque film, wherein the inner translucent film has perforations that extend completely through the thickness of the inner translucent film and the outer opaque film does not have perforations, the inner film comprising a plurality of rows of perforations, wherein a first row and a second row of perforations define outermost rows of perforations on the flap, and a plurality of rows of perforations in addition to the first and second rows are positioned between the first row and the second row, and wherein each row extends approximately from end to end along a length of the flap, and the inner film is oriented towards the cavity when the container is closed, and wherein the flap is a plastic film, wherein the tearable flap includes a tear initiating portion, the tear initiating portion including a pair of cuts through the tearable flap, wherein each cut ends within an area bounded by the outermost rows of perforations, and the ends of the cuts are separated by at least two rows of perforations.

10. The container of claim 9, wherein the two or more rows of perforations are substantially parallel to each other.

11. The container of claim 10, wherein the rows are along an edge of the container.

12. The container of claim 4, wherein the container is a bag or a box.

13. A tearable closure for opening a sealed container, comprising:

a polymer film having first and second sides and a thickness, the first side having a plurality of score lines that extend through a portion of the thickness and the second side not having score lines, wherein a first score line and a second score line define outermost score lines on the closure, and a plurality of score lines in addition to the first and second score lines are positioned between the first score line and the second score line, and wherein each score line extends approximately from end to end along a length of the closure, and the film is a continuous film of homogeneous composition, such that when the container is sealed the first side is oriented toward the interior of the container and the second side is oriented toward the exterior of the container, wherein the tearable opening includes a tear initiating portion, the tear initiating portion including a pair of cuts through the polymer film, wherein each cut ends within an area bounded by the outermost score lines, and the ends of the cuts are separated by at least two score lines.

14. A tearable closure for opening a sealed container, comprising:

first and second polymer films bonded together, the first film facing the interior of the sealed container and including a plurality of rows of perforations or score lines that extend through the thickness of the first film across the tearable closure, wherein a first row of perforations or score line and a second row of perforations or score line define outermost rows or lines on the closure, and a plurality of rows of perforations or score lines in addition to the first and second rows of perforations or score lines are positioned between the first row of perforations or score line and the second row of perforations or score line, and wherein each row of perforations or score line extends approximately from end to end along a length of the closure, and the second film faces the exterior of the sealed container and is a continuous film material, wherein the tearable closure includes a tear initiating portion, the tear initiating portion including a pair of cuts through the first and second polymer films, wherein each cut ends within an area bounded by the outermost rows of perforations or score lines, and the ends of the cuts are separated by at least two rows of perforations or score lines.

15. A container, comprising:

a container body defining a cavity; and a tearable flap connected to the container body, the flap being positionable in open and closed orientations, the flap comprising, a first side having rows or lines of areas of reduced thickness, wherein a first row or line and a second row or line define outermost rows or lines on the flap, a plurality of rows or lines areas of reduced thickness in addition to the first and second rows or lines are positioned between the first row or line and the second row or line, each row or line extends approximately from end to end along the length of the flap, a tab at one or both ends of the flap, wherein the tab includes two cut ends, wherein each cut ends within an area bounded by the outermost rows or lines of areas of reduced thickness, and the ends of the cuts are separated by at least two rows or lines of areas of reduced thickness, and a second side having a continuous film material, wherein the flap is a plastic film, such that when the flap is positioned in the dosed orientation the first side is an inner side and the second side is an exterior side.

16. The container of claim 15, wherein the tearable flap is formed from first and second plastic films, wherein the first film has perforations that extend completely through the thickness of the first film and wherein the second film does not have perforations.

17. The container of claim 15, wherein the tearable flap is formed from at least two films, wherein each film is formed from a plurality of layers.

18. The container of claim 15, wherein the tearable flap is formed from at least two films, wherein each film is a three layer co-extruded polyethylene film.

19. The container of claim 15, wherein the tearable flap is thrilled from a first and a second film, wherein the first film is translucent and the second film is opaque.

20. The container of claim 15, wherein the tearable flap does not have any strings, tear strips or tapes to assist with tearing the flap.

21. The container of claim 15, wherein the flap is made from polyethylene.

22. The container of claim 15, wherein the container is an envelope.

23. The container of claim 15, wherein the tearable flap comprises a plurality of score lines on the first side.

24. The container of claim 15, further comprising an adhesive strip extending approximately from end to end along a length of the flap.

25. The container of claim 15, further comprising an adhesive strip extending approximately from end to end along a length of the flap and a cover strip on the adhesive strip.

26. The container of claim 15, wherein the container is a bag or a box.

27. The container of claim 15, wherein the cuts are substantially parallel to or at an angle to the rows or lines of areas of reduced thickness.

28. The container of claim 1, wherein the cuts are substantially parallel to or at an angle with respect to the plurality of rows of perforations or score lines.

29. The container of claim 4, wherein the cuts are substantially parallel to or at an angle with respect to the plurality of score lines.

30. The container of claim 9, wherein the cuts are substantially parallel to or at an angle with respect to the plurality of rows of perforations.

31. The container of claim 13, wherein the cuts are substantially parallel to or at an angle with respect to the plurality of score lines.

32. The container of claim 14, wherein the cuts are substantially parallel to or at an angle with respect to the plurality of rows of perforations or score lines.

* * * * *

UNITED STATES PATENT AND TRADEMARK OFFICE

CERTIFICATE OF CORRECTION

PATENT NO. : 8,562,216 B2
APPLICATION NO. : 10/823080
DATED : October 22, 2013
INVENTOR(S) : B. A. Kendall et al.

It is certified that error appears in the above-identified patent and that said Letters Patent is hereby corrected as shown below:

In the Claims:

| COLUMN | LINE | ERROR |
|---|---|---|
| 9 (Claim 4, line 7) | 39 | delete "." and insert --,-- |
| 9 (Claim 4, line 22) | 54 | "separtated" should read --separated-- |
| 11 (Claim 15, line 23) | 27 | "dosed" should read --closed-- |
| 12 (Claim 19, line 2) | 2 | "thrilled" should read --formed-- |

Signed and Sealed this
Thirteenth Day of May, 2014

Michelle K. Lee

Michelle K. Lee
*Deputy Director of the United States Patent and Trademark Office*